US006510712B2

(12) United States Patent
Baseggio et al.

(10) Patent No.: US 6,510,712 B2
(45) Date of Patent: Jan. 28, 2003

(54) SLIDING-TONGUE COMPOUND NEEDLE FOR A KNITTING MACHINE

(75) Inventors: Marcello Baseggio, Ollon (CH); Michel Prost, Ollon (CH)

(73) Assignee: Atelier de Construction Steiger S.A., Vionnaz (CH)

( * ) Notice: Subject to any disclaimer, the term of this patent is extended or adjusted under 35 U.S.C. 154(b) by 0 days.

(21) Appl. No.: 10/079,622

(22) Filed: Feb. 19, 2002

(65) Prior Publication Data

US 2002/0112509 A1 Aug. 22, 2002

(30) Foreign Application Priority Data

Feb. 20, 2001 (FR) ..... 01 02272

(51) Int. Cl.[7] ..... D04B 35/06
(52) U.S. Cl. ..... 66/120
(58) Field of Search ..... 66/116, 120, 123, 66/117

(56) References Cited

U.S. PATENT DOCUMENTS 3,811,299 A * 5/1974 Peschl et al. ..... 66/120
4,584,852 A * 4/1986 Beck et al. ..... 66/116
5,186,026 A 2/1993 Groz et al.
5,937,673 A * 8/1999 Shima ..... 66/120
6,047,569 A 4/2000 Shima
6,233,977 B1 * 5/2001 Schuler et al. ..... 66/120
6,422,045 B1 * 7/2002 Morita et al. ..... 66/120

FOREIGN PATENT DOCUMENTS

EP 0 496 048 A 7/1992
EP 0 881 314 A 12/1998
EP 0 881 315 A 12/1998
FR 2 652 593 A 4/1991

OTHER PUBLICATIONS

Preliminary Search Report In SN FR 0102272.

* cited by examiner

*Primary Examiner*—Danny Worrell
(74) *Attorney, Agent, or Firm*—Bugnion S.A.; John Moetteli

(57) ABSTRACT

Sliding-tongue compound needle comprising a needle (1) equipped with a hook (3) and with a sliding tongue (2) straddling the needle and equipped with an end (12) and with a shoulder (13), the bottom of the sliding tongue being longitudinally slotted in its distal region comprising the end (12) and the shoulder (13) so as to allow the end to be parted, the sliding tongue being movable relative to the needle to close and open the hook of the needle and to carry a stitch by its shoulder. This needle has means (6) for the vertical guidance of the sliding tongue (2) as it moves relative to the needle (1) so that the sliding tongue moves in a non-rectilinear path.

10 Claims, 4 Drawing Sheets

SLIDING-TONGUE COMPOUND NEEDLE FOR A KNITTING MACHINE

BACKGROUND OF THE INVENTION

The invention relates to a sliding-tongue compound needle for a knitting machine comprising a needle equipped with a hook and a sliding tongue at least partially straddling the needle and equipped with at least one butt, with an end and with a shoulder, the bottom of this sliding tongue being longitudinally slotted in its distal region comprising the end and the shoulder so as to allow the end to be parted, by the needle or by an opposed needle or an opposed sliding tongue, the sliding tongue being movable relative to the needle so as to close and open the hook of the needle and so as to drive a stitch along via its shoulder.

A needle such as this is described in Patent Application EP 0 881 315, filed by the Applicant, the content of which is incorporated by reference hereto. In the embodiment described in that document, the bottom of the sliding tongue and the upper edge of the needle are rectilinear and parallel to the direction of travel of the needle. Movement of the sliding tongue is therefore also rectilinear and parallel to the direction of travel of the needle. Because of this configuration, when the needle advances relative to the sliding tongue to come into the position for preparing to transfer a stitch, the stitch that is to be transferred has to ride up a ramp on the needle until it is practically level with the bottom of the sliding tongue. This has the effect of exerting upward tension on the stitch and has the result of enlarging the stitch. This effect is further reinforced when the sliding tongue advances, carrying the stitch over the hook of the needle, the end and the shoulder of the sliding tongue passing very much over the hook of the needle. The fineness of the stitches that can be knitted is therefore limited.

In a compound needle of the conventional earlier type, that is to say in which the needle, in the form of a slider, equipped with a needle hook, lies under a slideway that closes and opens the hook, it has been proposed, in Patent FR 2 652 593, the content of which is incorporated herein by reference, that means be provided for raising and lowering the slideway relative to the bottom of the slot of the needle so as to reduce friction and tension on the stitch carried by the needle and obtain more even stitches. These means consist, on the one hand, of a bearing effect in the bottom of the slot of the needle and, on the other hand, of a lever effect exerted by the needle push rod. The path of the end of the slideway is not, however, governed tightly enough and, what is more, because of the general design of the needle, the slideway cannot move beyond the hook of the needle but merely moves back and forth between a lowered position and a raised position relative to the bottom of the sliding tongue.

SUMMARY OF THE INVENTION

The object of the present invention is therefore to allow the knitting of finer and more even stitches and, in addition, to make the transfer of stitches to one or more receiving elements easier.

To this end, the sliding-tongue compound needle according to the invention is one which has means for the positioning and vertical guidance of the sliding tongue in all positions of the sliding tongue as it moves relative to the needle, these means for the guidance and vertical positioning consisting exclusively and wholly of special shapes of the needle and of the sliding tongue and such that the sliding tongue moves along a nonrectilinear path controlled at all points and having rising and falling movements.

By guiding the sliding tongue in a perfectly controlled way, these guide means have the effect of reducing as far as possible the vertical tension on the stitch and therefore its enlargement. It is thus possible to knit finer and more even stitches.

According to a preferred embodiment of the invention, the bottom of the sliding tongue is open between the butt and approximately the middle of the sliding tongue, and the needle has an arm extending from the rear forward roughly parallel to the body of the needle, this arm passing through the sliding tongue via its open bottom to extend over the solid part of the sliding tongue so as to form, with the body of the needle, a fork in which the sliding tongue is guided.

To provide guidance, the internal dimensions of said fork and the bottom and back of the solid part of the sliding tongue are advantageously in the shape of cams providing the nonrectilinear movement of the sliding tongue, that is to say causing it to rise and fall relative to the needle.

According to one embodiment, the sliding tongue has, at the rear, at least one bearing point collaborating with the body of the needle to prevent inadvertent rocking of the sliding tongue and/or to induce a movement of the rear of the sliding tongue in a vertical plane relative to the needle. In this last instance, at least one of the sides of the needle body against which the bearing point rests, is in the form of a cam.

BRIEF DESCRIPTION OF THE DRAWINGS

The appended drawing depicts, by way of example, one embodiment of the invention.

DETAILED DESCRIPTION

Figure 1:
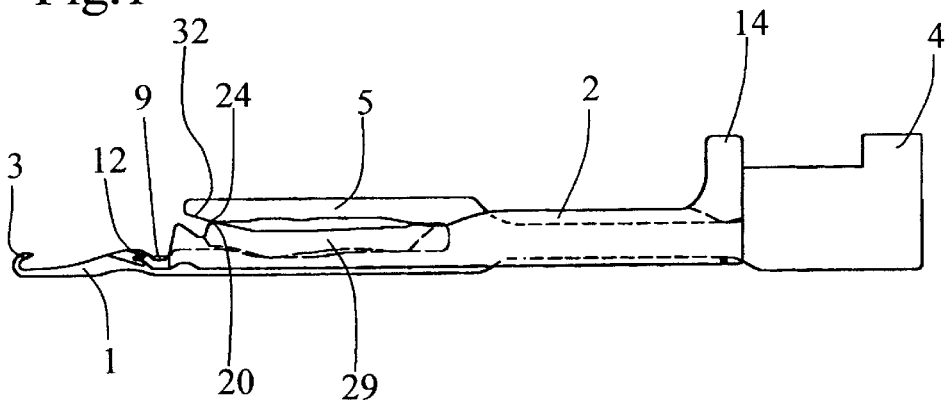
FIG. 1 is a side view of the sliding-tongue compound needle.
Figure 2:
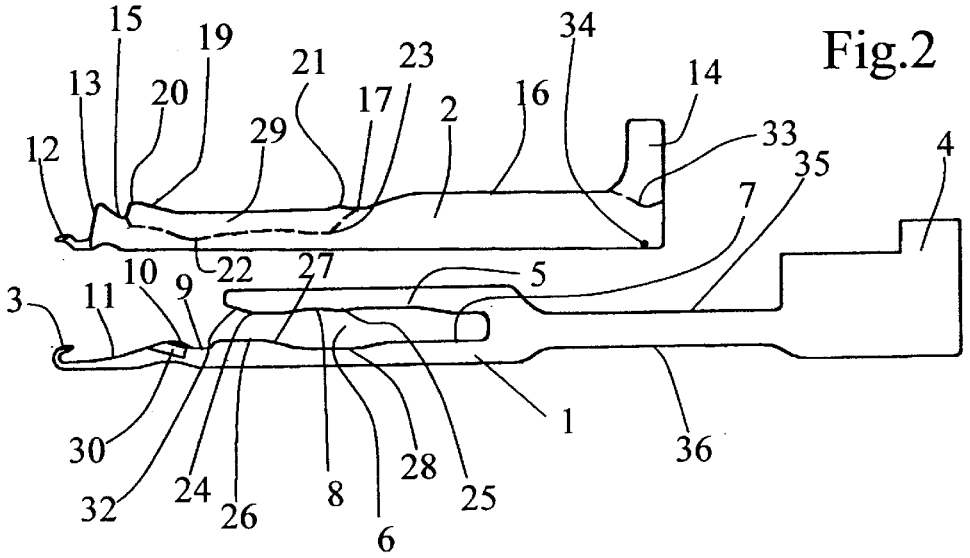
FIG. 2 depicts the needle and the sliding tongue separate from one another.
Figure 3:
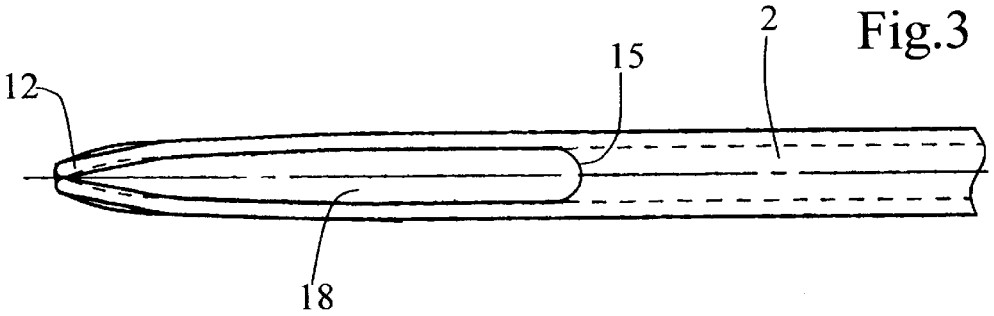
FIG. 3 is a view from above, enlarged, of the front part of the sliding tongue.

The shape of the needle and of the sliding tongue will first of all be described in relation to FIGS. 1 to 3.

The compound needle consists of a needle 1 and of a sliding tongue 2 straddling the needle 1 in a way similar to the sliding tongue of the sliding-tongue needle described in document EP-A-0 881 315. For that purpose, the sliding tongue 2 has a profile in the shape of an inverted U, but over just part of its length for reasons which will become apparent later.

The needle 1 is equipped, in the conventional way, with a hook 3. In the embodiment depicted, the needle 1 is equipped with a butt 4 for driving it via the cams of a cam carriage. The needle could, however, be driven by a drive bolt. Approximately at its middle, the needle is equipped with an arm 5 extending forward, above the needle proper, parallel to the longitudinal axis of the needle, that is to say to the direction of travel of this needle in its needle bed. The needle 1 and the arm 5 form a fork 6, the internal sides 7 and 8 of which have a nonrectilinear contour in the form of a cam. The side 7 in the form of a cam extends beyond the fork 6 where it has a depression 9 followed by a ramp 10 rising up forward. Forward of this ramp 10, the needle tapers, in a known way, in a downward ramp 11 as far as the hook 3.

The sliding tongue 2 has, at the front, an end 12 situated in front of a shoulder 13 and is equipped at the rear with a butt 14 for driving it. The bottom of the sliding tongue 2 is eliminated at two points, on the one hand in its distal part, forward of a point 15 situated slightly to the rear of the shoulder 13 and, on the other hand, in its rear half 16, between the butt 14 and a point 17 situated approximately mid-way along the sliding tongue.

Viewed from above, the distal part of the sliding tongue is depicted in FIG. 3. The interruption of the U-shaped profile of the sliding tongue forms a slot 18 which narrows at the end of the sliding tongue to form the end 12, at the end of which the sides of the slot 18 meet. The two sides of the slot 18 may be parted from one another elastically.

The interruption 16 of the bottom of the sliding tongue forms a cut-out of a width corresponding to the thickness of the needle. This cut-out has, passing through it, the arm 5 of the needle which extends above the sliding tongue proper, that is to say above the region 29 of the sliding tongue in which the bottom of the sliding tongue is uninterrupted. This region 29 externally, at the front, has a ramp 19 ending in a nose 20 and, at the rear, a small boss 21. Internally, the bottom of the sliding tongue has a first boss 22 in its front part and a second boss 23 at the rear. Between these bosses, the bottom of the sliding tongue has a slight depression.

At the rear, at the height of the butt 14, the sliding tongue 2 has two bearing points 33 and 34 collaborating respectively with the upper side 35 and lower side 36 of the bottom of the needle to prevent inadvertent rocking of the sliding tongue. These bearing points may furthermore be used to induce an additional movement of the sliding tongue relative to the needle, for example to retract its butt 14 relative to a cam of the cam carriage or to obtain a finer and more precise movement of its end 12. In this case, at least one of the sides 35, 36 of the needle body is nonrectilinear, that is to say is in the form of a cam. The bearing point 33 is formed by a boss in the bottom of the sliding tongue and the bearing point 34 is formed, for example, by the upsetting of material of the walls of the sliding tongue.

As regards the interior profile of the fork 6 of the needle, this has, starting from the end of the arm 5, a disengagement ramp 32 followed by a boss 24 followed by a slight depression and a second, not very pronounced, boss 25 and, on the needle proper, a tall part 26 of constant height between the depression 9 and a ramp 27 ending at a depression 28.

As can be seen in FIG. 1, when the needle is assembled, the region 29 of the sliding tongue lies in the fork 6 of the needle, which provides nonrectilinear guidance of the sliding tongue 2 as it moves. In FIG. 1, the sliding tongue is depicted in its rearmost position on the needle. In this position, the boss 24 of the arm S of the needle rests against the nose 20 of the sliding tongue and this has the effect of positioning the end 12 of the sliding tongue in a lowered position of minimal height relative to the needle. In this position, the two sides of the end 12 are parted by the needle 1 and so the end 12 and the depression situated behind this end are at all points below the upper edge of the needle.

Figure 4:
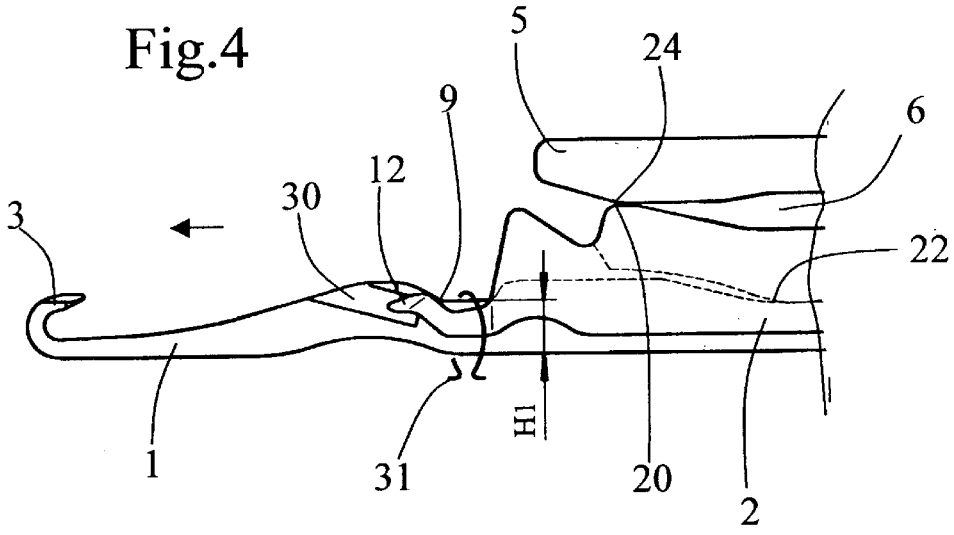
FIGS. 4 to 11 show eight successive positions of the sliding tongue relative to the needle from one extreme position to the other, particularly in the case of the transfer of a stitch.

The complete movement of the sliding tongue on the needle will now be described in relation to FIGS. 4 to 11 which depict eight successive positions of the sliding tongue relative to the needle starting from the position depicted in FIG. 1 which is the same position as the one depicted in FIG. 4.

The sequence depicted illustrates the transferring of a stitch. In the position depicted in FIG. 4, the sliding tongue 2 is positioned in the fork 6 by its nose 20 and its boss 22. The end 12 of the sliding tongue, which is open, is situated below the upper edge of the needle 1. The two sides of the end 12 rest on the sides of the needle on two millings 30 which reduce the thickness of the needle and therefore the opening of the end 12 so as not to exceed the width of the sliding tongue. The stitch 31 that is to be transferred is carried by the needle 1 so that it exerts no pressure on the sliding tongue 2 which is supported cantilever fashion, and avoids slowing of the sliding tongue. The end 12 is at that moment at a height H1 relative to the lower edge of the needle, that is to say relative to the bottom of the slot of the needle bed in which the needle slides. This level H1 is the minimum level of the end 12 in the path of the sliding tongue.

Figure 5:
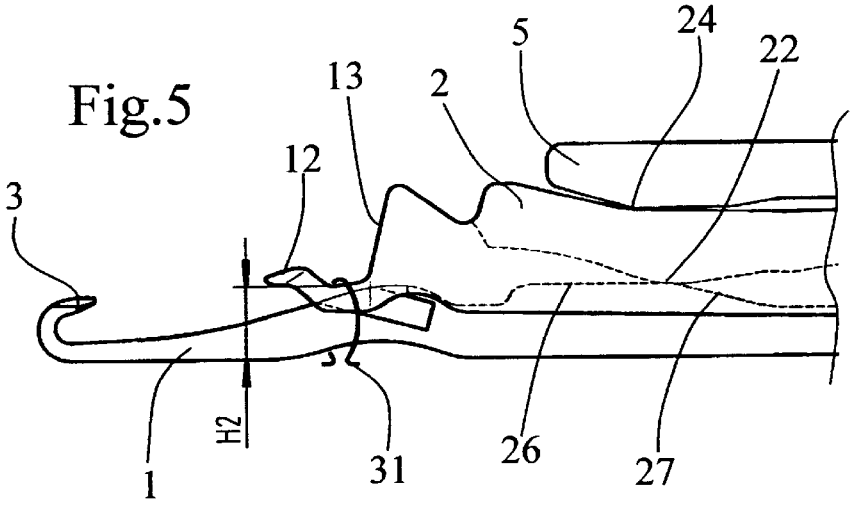

As the sliding tongue 2 advances, its boss 22 rises up the ramp 27 of the needle to arrive on the tall part 26 (FIG. 5). Toward the top, the sliding tongue is retained and guided by the boss 24 of the arm 5 of the needle. This rise of the sliding tongue is just enough for the depression at the rear of the end 12 of the sliding tongue to come slightly above the level of the needle. During this rise of the sliding tongue, the end 12 closes again and the stitch 31 is carried along by the shoulder 13 of the sliding tongue. The level H2 reached by the end 12 of the sliding tongue is the highest level relative to the needle reached by the sliding tongue in its movement.

Figure 6:
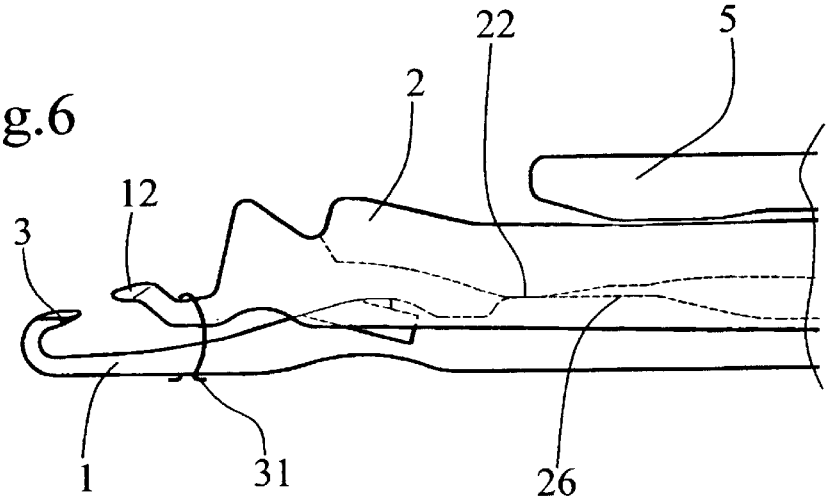

The sliding tongue 2 continues its advance, resting on the top part of constant level 26 of the needle, that is to say maintaining the level H2, as depicted in FIG. 6.

Figure 7:
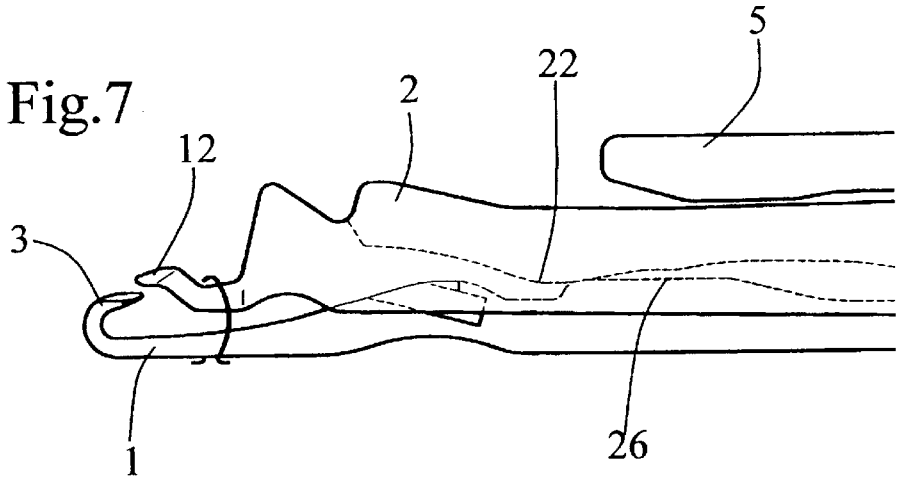

The boss 22 of the sliding tongue then leaves the part 26 of the needle so that the end 12 of the sliding tongue drops towards the hook 3 of the needle, as depicted in FIG. 7.

Figure 8:
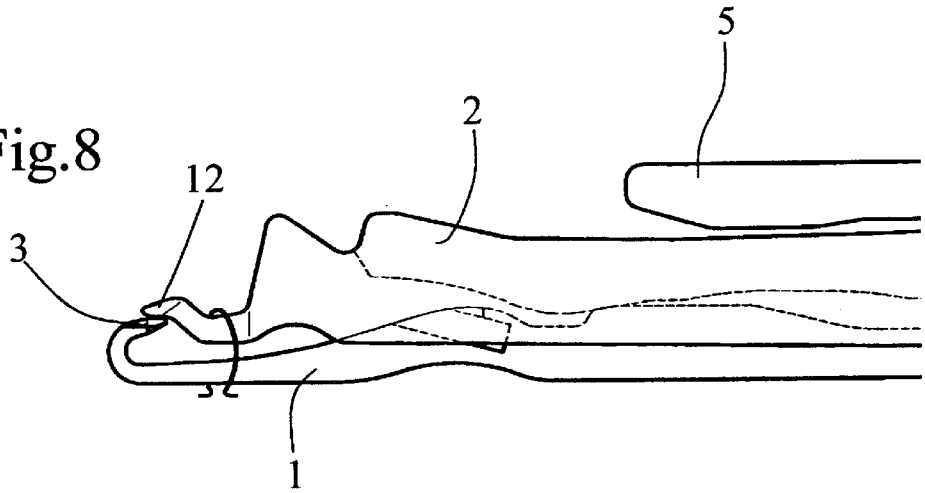
Figure 9:
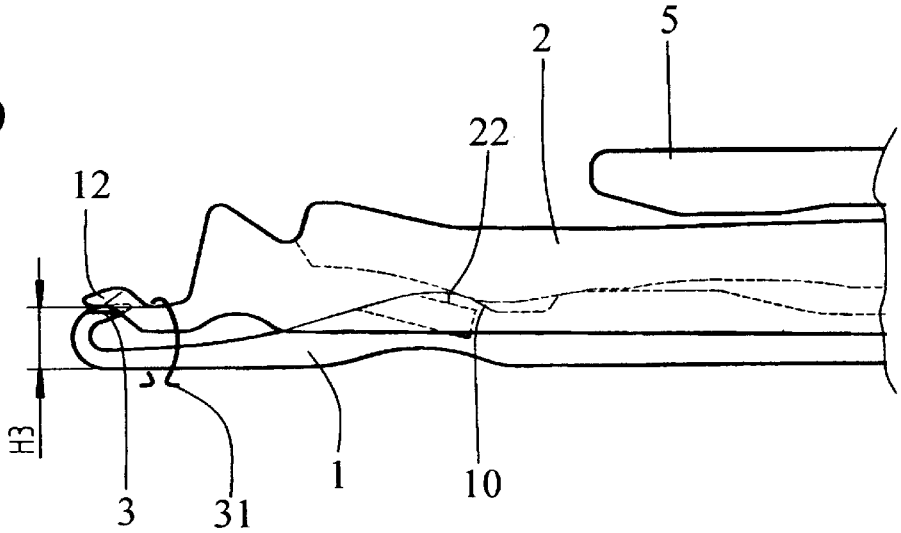

Continuing its fall, the sliding tongue 2 caps the hook 3 of the needle with its end 12, as depicted in FIG. 8. This movement corresponds to the closure movement of a conventional latch needle by its latch.

Figure 10:
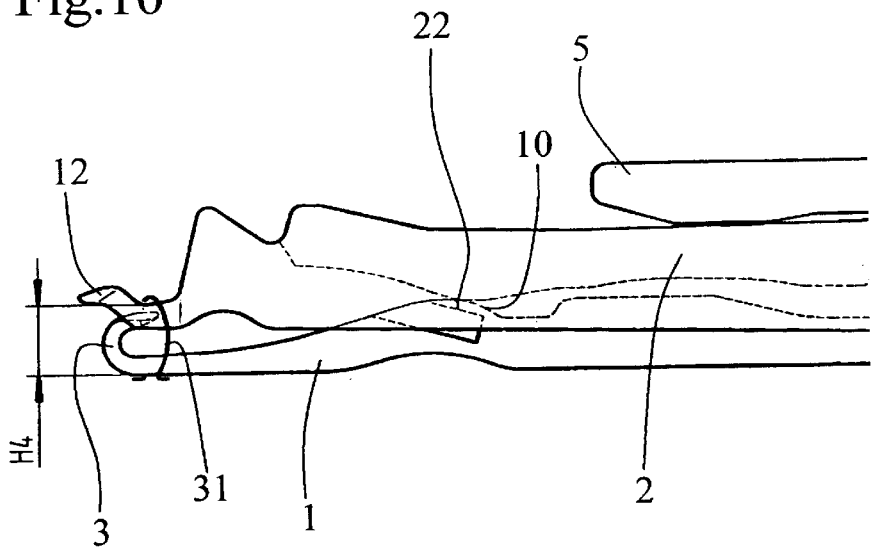

With the sliding tongue continuing to move, its boss 22 arrives against the ramp 10 of the needle so that the sliding tongue 2 and its end 12 begin a rising movement (FIG. 9) which continues until the end 12 reaches a level H4 (FIG. 10). This rising movement has the purpose of preventing the hook 3 of the needle from catching on filaments of the stitch 31 present on the sliding tongue.

Once the hook 3 has passed, the boss 22 of the sliding tongue 2 falls back down along the ramp 11 of the needle and leaves it while the boss 23 takes over on the face 26 of the needle and the end 12 reaches a low level H5 and maintains this level to the end of its travel. This fall has the effect of avoiding deformation of the stitch 31 in tension (FIG. 11).

Figure 11:
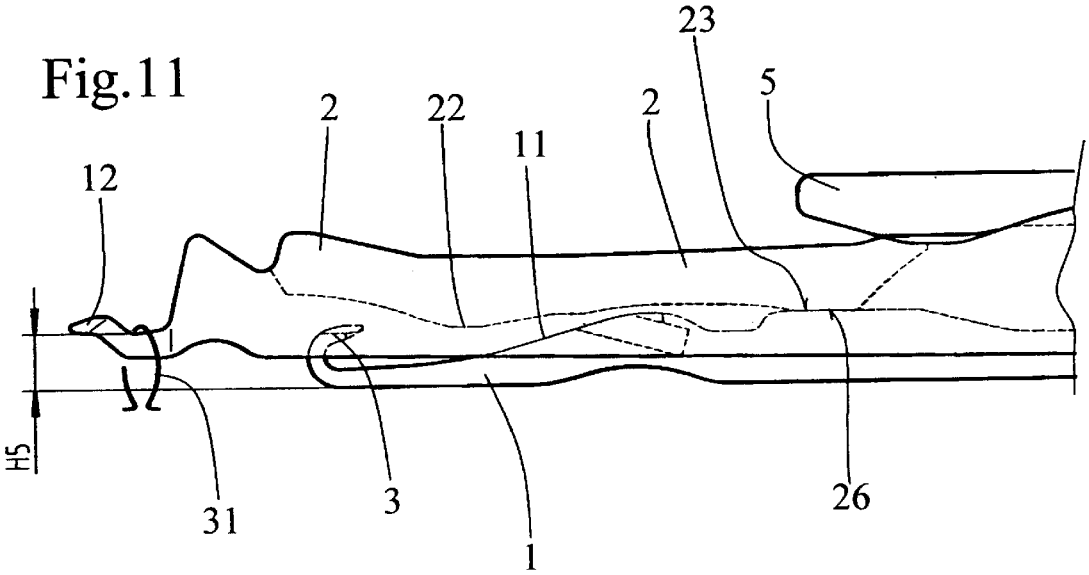

In the position depicted in FIG. 11, the stitch 31 can be grasped by an opposed needle (transfer) or by a sliding tongue (stitch transfer between neighbouring needles) as described in Patent EP 0 881 315, that is to say by introducing this needle or this sliding tongue into the end 12.

In alternative forms of embodiment, the sliding tongue could completely straddle the needle and could be equipped with two or more butts. The sliding tongue could, at the rear, have a single bearing point, for example the bearing point 34 (FIG. 2).

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed:

1. A sliding-tongue compound needle for a knitting machine comprising a needle (1) equipped with a hook (3) and a sliding tongue (2) at least partially straddling the needle and equipped with at least one butt (14), with an end (12) and with a shoulder (13), the bottom of the sliding tongue being longitudinally slotted in its distal region comprising the end (12) and the shoulder (13) so as to allow the end to be parted, the sliding tongue being movable relative to the needle so as to close and open the hook of the needle and so as to drive a stitch along via its shoulder, and which has a device (6) for the positioning and vertical guidance of the sliding tongue (2) in all positions of the sliding tongue as it moves relative to the needle (1), the device being a special shape of the needle and of the sliding tongue, such that the sliding tongue moves along a nonrectilinear path controlled at all points and having rising and falling movements.

2. The compound needle as claimed in claim 1, wherein the bottom of the sliding tongue (2) is open (16) between the butt (14) and approximately the middle (17) of the sliding tongue, and the needle has an arm (5) extending from the rear forward roughly parallel to the body of the needle, this arm passing through the sliding tongue via its open bottom (16) to extend over the solid part (29) of the sliding tongue so as to form, with the body of the needle, the device (6) in which the sliding tongue is guided.

3. The compound needle as claimed in claim 2, wherein the interior dimensions of said fork (6) and the bottom and back of the solid part (29) of the sliding tongue are in the shape of cams providing the nonrectilinear movement of the sliding tongue, that is to say causing it to rise and fall relative to the needle.

4. The compound needle as claimed in claim 3, wherein the needle (1) has two lateral millings (30) reducing the opening of the end (12) of the sliding tongue by the needle when the end is lowered below the upper edge of the needle.

5. The compound needle as claimed in one of claims 1 to 4, wherein guidance is such that when the needle (1) is in the position of preparing to transfer a stitch, with the sliding tongue withdrawn to its maximum extent relative to the needle and with the end of the sliding tongue below the upper edge of the needle, the stitch is supported by the needle.

6. The compound needle as claimed in claim 5, wherein guidance is such that when the sliding tongue (2) moves forward from its position of maximum withdrawal, taking a stitch with it, this sliding tongue first of all rises to carry the stitch on its shoulder, then falls again as far as the position in which the hook of the needle is closed, then rises again slightly to avoid the hook catching on stitch filaments, and finally falls again so as to reduce the tension on the stitch.

7. The needle as claimed in one of claims 1 to 4, wherein the sliding tongue has, at the rear, at least one bearing point (33, 34) collaborating with the body of the needle (35, 36) to prevent inadvertent rocking of the sliding tongue and/or to induce a movement of the rear of the sliding tongue in a vertical plane relative to the needle.

8. The needle as claimed in claim 5, wherein the sliding tongue has, at the rear, at least one bearing point (33, 34) collaborating with the body of the needle (35, 36) to prevent inadvertent rocking of the sliding tongue and/or to induce a movement of the rear of the sliding tongue in a vertical plane relative to the needle.

9. The needle as claimed in claim 6, wherein the sliding tongue has, at the rear, at least one bearing point (33, 34) collaborating with the body of the needle (35, 36) to prevent inadvertent rocking of the sliding tongue and/or to induce a movement of the rear of the sliding tongue in a vertical plane relative to the needle.

10. The needle as claimed in claim 7, wherein at least one of the sides (35, 36) of the needle body against which the bearing point (33, 34) rests, is in the form of a cam.

* * * * *